US009442421B2

(12) United States Patent
Shinozaki et al.

(10) Patent No.: US 9,442,421 B2
(45) Date of Patent: Sep. 13, 2016

(54) ROTATABLE POWDER STORAGE CONTAINER

(71) Applicant: FUJI XEROX CO., LTD., Tokyo (JP)

(72) Inventors: Seigo Shinozaki, Kanagawa (JP); Makoto Kanno, Kanagawa (JP); Shota Oba, Kanagawa (JP); Norihiro Tamazawa, Kanagawa (JP); Ayumi Noguchi, Kanagawa (JP); Shigeru Inaba, Kanagawa (JP); Shinichiro Fujimori, Kanagawa (JP); Kiyohito Horii, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/607,835

(22) Filed: Jan. 28, 2015

(65) Prior Publication Data

US 2016/0091819 A1 Mar. 31, 2016

(30) Foreign Application Priority Data

Sep. 25, 2014 (JP) ..... 2014-194942

(51) Int. Cl.
*G03G 15/08* (2006.01)

(52) U.S. Cl.
CPC ..... *G03G 15/0865* (2013.01); *G03G 15/0837* (2013.01); *G03G 15/0872* (2013.01); *G03G 2215/0668* (2013.01)

(58) Field of Classification Search
CPC ..... G03G 15/0835; G03G 15/0837; G03G 15/087; G03G 15/0872; G03G 2215/0663; G03G 2215/0665; G03G 2215/0668; G03G 2215/067
USPC ..... 399/262, 263; 222/325, 410, 411, 548, 222/DIG. 1
See application file for complete search history.

(56) References Cited

U.S. PATENT DOCUMENTS 5,907,756 A * 5/1999 Shirota et al. ..... 399/262
5,966,574 A * 10/1999 Ui ..... G03G 15/0877 222/DIG. 1
8,155,568 B2 4/2012 Naito et al.

(Continued)

FOREIGN PATENT DOCUMENTS

JP 2005082152 A * 3/2005
JP 2005292676 A * 10/2005

(Continued)

OTHER PUBLICATIONS

Translation of Apr. 21, 2015 Office Action issued in Japanese Patent Application No. 2014-194942.

(Continued)

*Primary Examiner* — Robert Beatty
(74) *Attorney, Agent, or Firm* — Oliff PLC

(57) ABSTRACT

A powder storage device includes a powder container that has an opening at one end, stores powder therein, and has, on an inner peripheral surface, a rib configured to transport the powder toward the opening with rotation of the powder container, a lid member that is configured to cover the opening, has an outflow opening through which the powder flows, and is held in a non-rotatable state, and a driving-force transmission member interposed between the powder container and the lid member and having a driving-force receiving portion penetrating the lid member in a rotation axis direction, the driving-force transmission member transmitting a rotating force to the powder container.

18 Claims, 11 Drawing Sheets

(56) References Cited

U.S. PATENT DOCUMENTS

| | | | | |
|---|---|---|---|---|
| 8,824,934 | B2 * | 9/2014 | Hayashi et al. | 399/258 |
| 2004/0190945 | A1 * | 9/2004 | Yamada | 399/258 |
| 2007/0092302 | A1 | 4/2007 | Koyama | |
| 2012/0183333 | A1 | 7/2012 | Ohgoshi et al. | |
| 2014/0169837 | A1 * | 6/2014 | Huang et al. | 399/262 |
| 2016/0091825 | A1 * | 3/2016 | Oba G03G 15/0865 | 399/254 |

FOREIGN PATENT DOCUMENTS

| | | | |
|---|---|---|---|
| JP | 2006-071762 | A | 3/2006 |
| JP | 2006-084755 | A | 3/2006 |
| JP | 2009-015056 | A | 1/2009 |
| JP | 2009-204631 | A | 9/2009 |
| JP | 2009-271280 | A | 11/2009 |
| JP | 2011-203327 | A | 10/2011 |
| JP | 2011-227354 | A | 11/2011 |
| JP | 2013-148881 | A | 8/2013 |

OTHER PUBLICATIONS

Translation of Aug. 18, 2015 Office Action issued in Japanese Patent Application No. 2014-194942.

Feb. 16, 2016 Office Action issued in Australian Patent Application No. 2015200939.

* cited by examiner

Related Art

Related Art

ROTATABLE POWDER STORAGE CONTAINER

CROSS-REFERENCE TO RELATED APPLICATIONS

This application is based on and claims priority under 35 USC 119 from Japanese Patent Application No. 2014-194942 filed Sep. 25, 2014.

BACKGROUND

Technical Field

The present invention relates to a powder storage device.

SUMMARY

According to an aspect of the invention, there is provided a powder storage device including a powder container that has an opening at one end, stores powder therein, and has, on an inner peripheral surface, a rib configured to transport the powder toward the opening with rotation of the powder container, a lid member that is configured to cover the opening, has an outflow opening through which the powder flows, and is held in a non-rotatable state, and a driving-force transmission member interposed between the powder container and the lid member and having a driving-force receiving portion penetrating the lid member in a rotation axis direction, the driving-force transmission member transmitting a rotating force to the powder container.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below.

Figure 1:
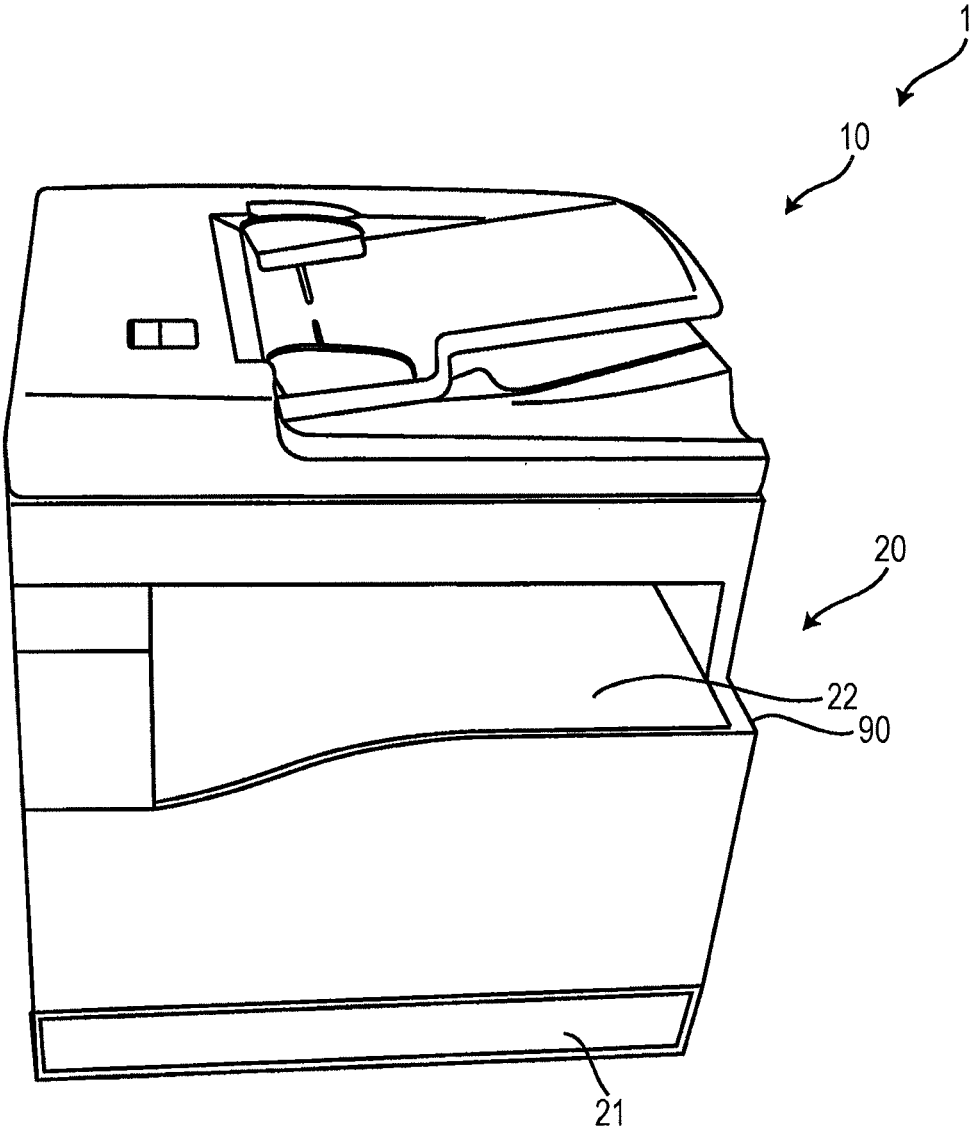
FIG. 1 is an external perspective view of an image forming apparatus according to a first exemplary embodiment of the present invention.

FIG. 1 is an external perspective view of an image forming apparatus 1 according to a first exemplary embodiment of the present invention.

The image forming apparatus 1 includes a scanner 10 and a printer 20.

The scanner 10 is disposed on an apparatus housing 90 serving as a frame of the image forming apparatus 1. The printer 20 is provided within the apparatus housing 90.

Figure 2:
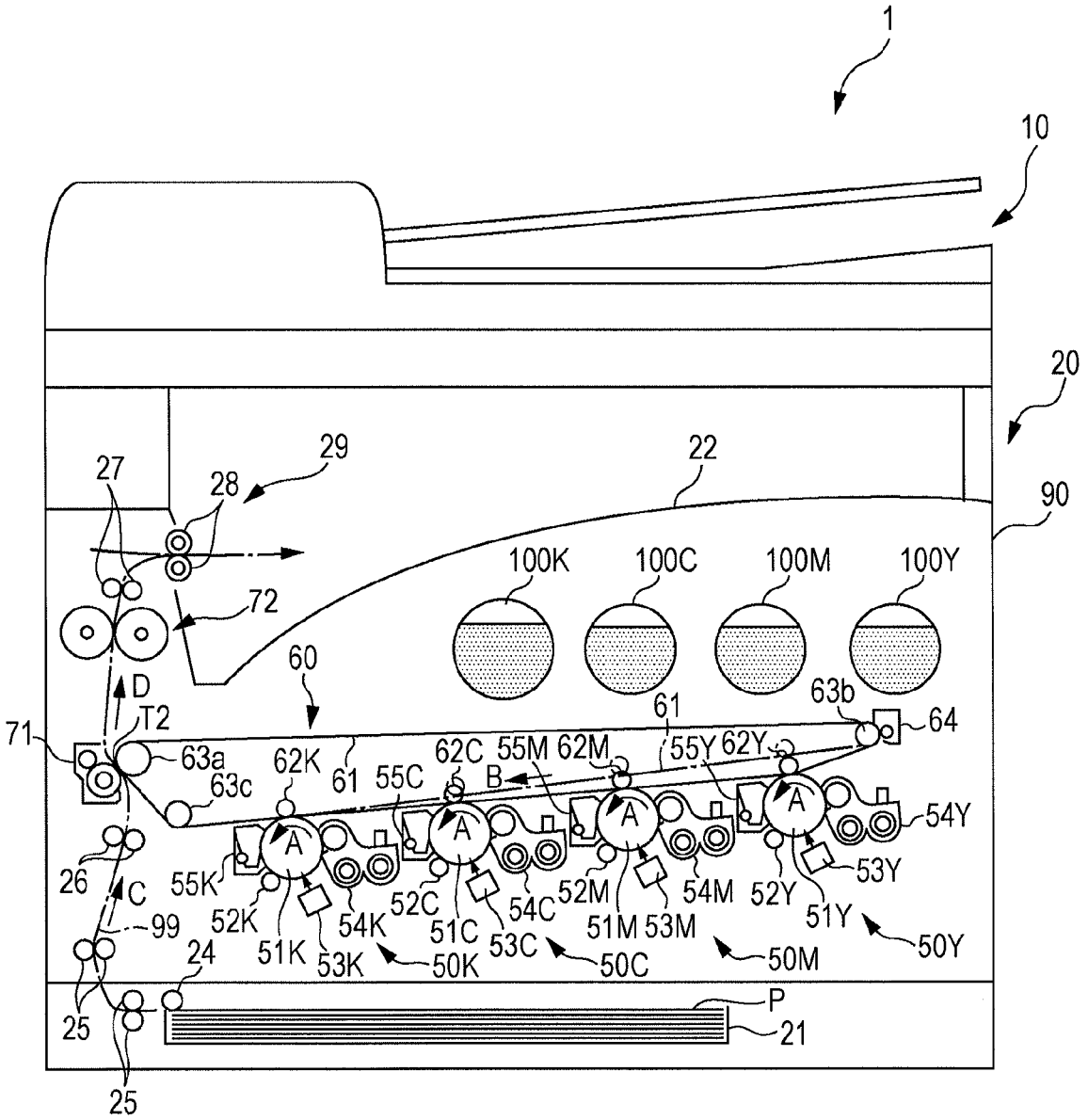
FIG. 2 is a schematic view illustrating the inner configuration of the image forming apparatus whose external appearance is illustrated in FIG. 1.

FIG. 2 is a schematic view illustrating the internal configuration of the image forming apparatus 1 whose external appearance is illustrated in FIG. 1.

The printer 20 includes four image forming sections 50Y, 50M, 50C, and 50K arranged in line in a substantially lateral direction. These image forming sections 50Y, 50M, 50C, and 50K form toner images of toner colors of yellow (Y), magenta (M), cyan (C), and black (K), respectively. Herein, in the description common to these image forming sections 50Y, 50M, 50C, and 50K, the letters Y, M, C, and K representing the toner colors are omitted, and the image forming sections 50Y, 50M, 50C, and 50K are referred to image forming sections 50. This also applies to the constituent elements other than the image forming sections.

Each image forming section 50 includes a photoconductor 51. While the photoconductor 51 is being rotated in a direction of arrow A by received driving force, an electrostatic latent image is formed on a surface of the photoconductor 51, and the electrostatic latent image is developed into a toner image.

Around the photoconductor 51 provided in each image forming section 50, a charger 52, an exposure unit 53, a developing unit 54, a first transfer unit 62, and a cleaner 55 are arranged. Herein, the first transfer unit 62 is disposed at a position such as to keep an intermediate transfer belt 61 (to be described later) in between the first transfer unit 62 and the photoconductor 51. The first transfer unit 62 is an element that is not provided in the image forming section 50, but is provided in an intermediate transfer unit 60 (to be described later).

The charger 52 uniformly charges the surface of the photoconductor 51.

The exposure unit 53 radiates exposure light modulated according to image signals onto the uniformly charged photoconductor 51, and thereby forms an electrostatic latent image on the photoconductor 51.

The developing unit 54 develops the electrostatic latent image formed on the photoconductor 51 with toner of a color corresponding to the image forming section 50, and thereby forms a toner image on the photoconductor 51.

The first transfer unit 62 transfers the toner image formed on the photoconductor 51 onto an intermediate transfer belt 61 (to be described later).

The cleaner 55 removes residual toner and the like from the photoconductor 51 after transfer.

An intermediate transfer unit 60 is disposed on an upper side of the four image forming sections 50. The intermediate transfer unit 60 includes an intermediate transfer belt 61. The intermediate transfer belt 61 is supported by plural rollers such as a driving roller 63*a*, a driven roller 63*b*, and a stretching roller 63*c*. The intermediate transfer belt 61 is driven by the driving roller 63*a*, and circulates in a direction of arrow B on a circulation path including a path along four photoconductors 51 provided in the four image forming sections 50.

Toner images on the photoconductors 51 are transferred in order by the action of the corresponding first transfer units 62 so as to be superimposed on the intermediate transfer belt 61. The toner images transferred on the intermediate transfer belt 61 are transported to a second transfer position T2 by the intermediate transfer belt 61. At the second transfer position T2, a second transfer unit 71 is provided. The toner images on the intermediate transfer belt 61 are transferred, by the action of the second transfer unit 71, onto paper P transported to the second transfer position T2. Transportation of paper P will be described later. After the toner images are transferred on the paper P, toner and the like remaining on the intermediate transfer belt 61 are removed from the intermediate transfer belt 61 by a cleaner 64.

Above the intermediate transfer unit 60, toner cartridges 100 are provided to store color toners. When toner in any of the developing units 54 is consumed by development, toner is supplied to the developing unit 54 through an unillustrated toner supply path from the toner cartridge 100 that stores toner of the corresponding color. Each of the toner cartridges 100 is removably loaded in the apparatus housing 90. When the toner cartridge 100 becomes empty, it is removed, and a new toner cartridge 100 is loaded.

One sheet of paper P is taken out from a paper tray 21 by a pickup roller 24, and is transported to timing adjustment rollers 26 in a direction of arrow C in a transport path 99 by transport rollers 25. The paper P transported to the timing adjustment rollers 26 is fed out toward the second transfer position T2 by the timing adjustment rollers 26 so that it reaches the second transfer position T2 in synchronization with the time when the toner images on the intermediate transfer belt 61 reach the second transfer portion T2. At the second transfer position T2, the toner images are transferred from the intermediate transfer belt 61 onto the paper P, which is fed out by the timing adjustment rollers 26, by the action of the second transfer unit 71. The paper P on which the toner images are transferred is further transported in a direction of arrow D, and passes through a fixing unit 72. The toner images on the paper P are fixed on the paper P with heat and pressure applied from the fixing unit 72. Thus, an image formed by the fixed toner images is printed on the paper P. The paper P on which the toner images are fixed by the fixing unit 72 is further transported by transport rollers 27, and is sent from a paper output port 29 onto a paper output tray 22 by paper output rollers 28.

Next, the structure of the toner cartridges 100 will be described.

Before describing a toner cartridge of the first exemplary embodiment of the present invention, a toner cartridge as a comparative example will be described first. After that, the toner cartridge according to the exemplary embodiment of the present invention will be described on the basis of the description of the comparative example.

Figure 3:
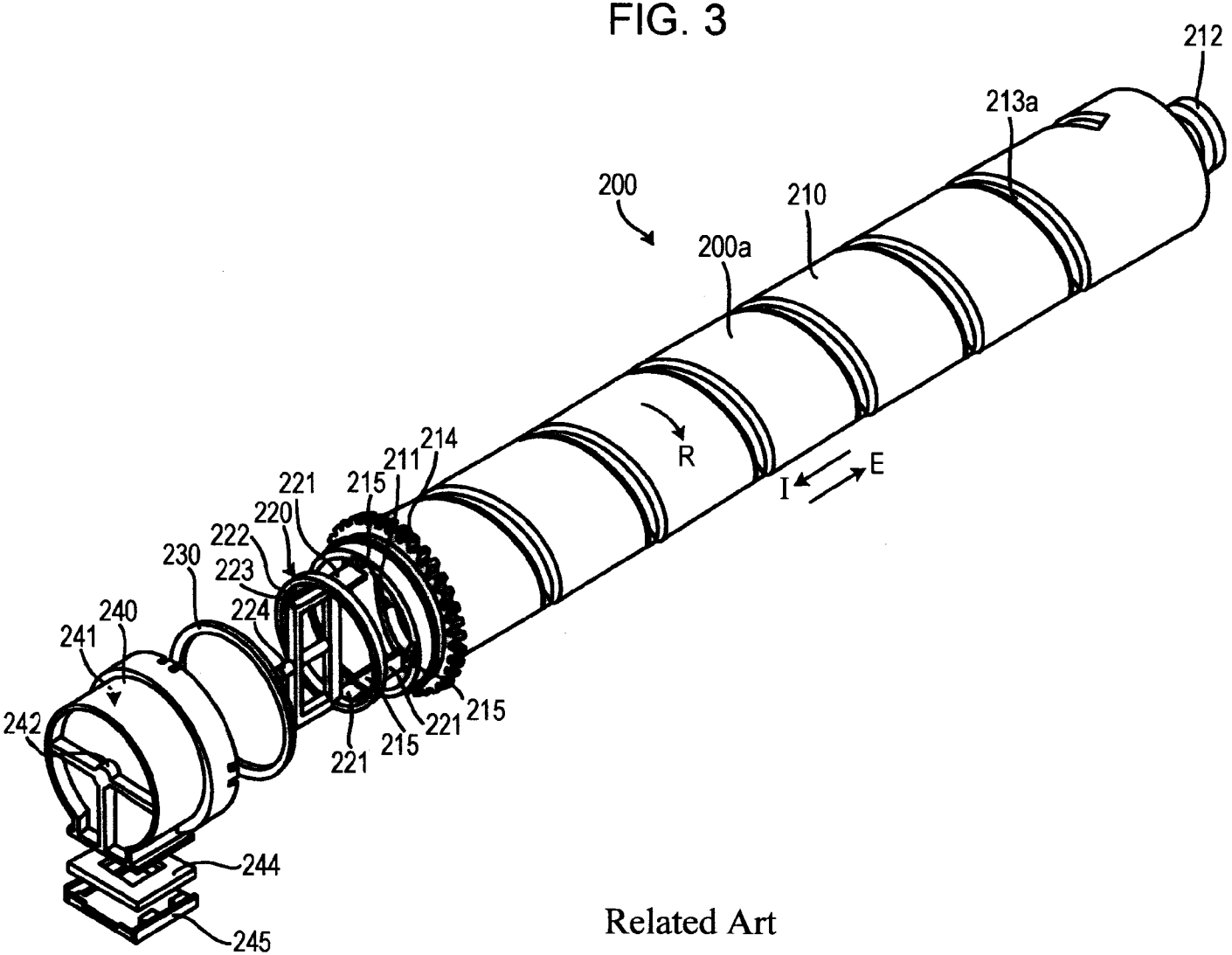
FIG. 3 is an exploded perspective view of a toner cartridge according to a comparative example.

FIG. 3 is an exploded perspective view of a toner cartridge 200 according to a comparative example.

Figure 4:
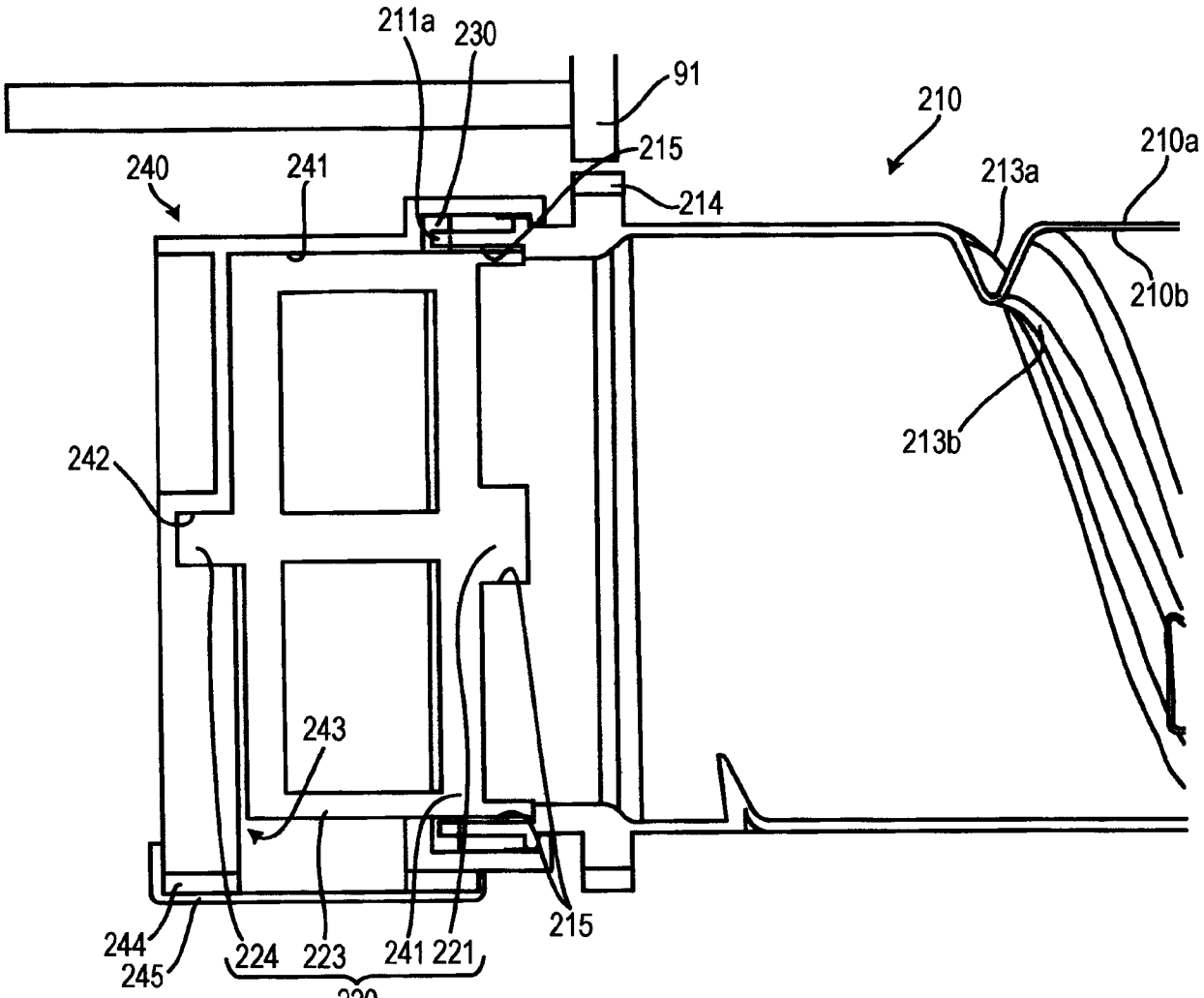
FIG. 4 is a cross-sectional view of a portion near a flange in the toner cartridge of the comparative example illustrated in FIG. 3.

FIG. 4 is a cross-sectional view of a portion near a flange in the toner cartridge of the comparative example illustrated in FIG. 3.

The toner cartridge 200 includes a toner bottle 210, an agitation member 220, a seal member 230, and a flange 240. The toner cartridge 200 is inserted into an image forming apparatus in a direction of arrow I in a state in which toner is stored in the toner bottle 210 and the toner cartridge 200 is assembled. The toner cartridge 200 is the comparative example, and is not inserted in the image forming apparatus 1 of the first exemplary embodiment illustrated in FIGS. 1 and 2. However, the image forming apparatus in which the toner cartridge 200 is to be inserted is illustrated similarly to FIGS. 1 and 2 at the same level of the drawings as FIGS. 1 and 2. Accordingly, this description will be given on the assumption that the toner cartridge 200 is to be inserted into the image forming apparatus 1 of FIGS. 1 and 2. When the toner bottle 210 becomes empty, the toner cartridge 200 is drawn out in a direction of arrow E, and a new toner cartridge 200 is inserted.

The toner bottle 210 is substantially cylindrical, has an opening 211 at one end, and stores toner therein. The other end of the toner bottle 210 is provided with a handle 212 used to draw out the toner cartridge 200 from the image forming apparatus 1. Further, a helically extending groove 213*a* is provided in an outer peripheral surface 210*a* of the toner bottle 210. As illustrated in FIG. 4, the groove 213*a* projects in an inner peripheral surface 210*b* of the toner bottle 210. That is, a helical rib 213*b* is provided on the inner peripheral surface 210*b*. On the outer peripheral surface 210*a* of the toner bottle 210, a gear 214 is also provided near the opening 211. When the toner cartridge 200 is loaded in the image forming apparatus 1, the gear 214 is engaged with a gear 91 (see FIG. 4) on the image forming apparatus body side provided in the apparatus housing 90. The toner bottle 210 is rotated in a direction of arrow R by rotating force received from a motor (not illustrated) on the apparatus body side. The toner bottle 210 is filled with toner. When the toner bottle 210 rotates, the toner is transported toward the opening 211 by the helical rib 213*b* on the inner peripheral surface 210*b*.

A peripheral surface around the opening 211 is provided with plural key grooves 215. Keys 221 of the agitation member 220 are fitted in the key grooves 215. Therefore, when the toner bottle 210 rotates, the agitation member 220 rotates together.

The agitation member 220 includes an annular base portion 222. Plural keys 221 protrude from the base portion 222 toward the toner bottle 210. The agitation member 220 further includes an agitating blade 223 protruding from the base portion 222 toward the flange 240.

As illustrated in FIG. 4, the flange 240 has a hollow cylindrical portion 241 opening to be opposed to the toner bottle 210. The agitating blade 223 of the agitation member 220 is disposed within the cylindrical portion 241 of the flange 240. The agitating blade 223 agitates the toner moved from the opening 211 of the toner bottle 210 into the flange 240 to prevent agglomeration of the toner. A shaft 224 protrudes from a distal end of the agitating blade 223. The shaft 224 is fitted in a bearing portion 242 of the flange 240 to maintain the posture of the agitation member 220. The cylindrical portion 241 of the flange 240 has a large cylindrical stepped part on the side of the toner bottle 210, and a ring-shaped seal member 230 is fitted in the cylindrical part. The seal member 230 is pressed and crushed by a rim 211*a* of the opening 211 of the toner bottle 210. The seal member 230 prevents the toner from leaking from a gap between the toner bottle 210 and the flange 240.

The flange 240 has an outflow opening 243 from which the toner flows out. The periphery of the outflow opening 243 is covered with another seal member 244. Further, the outflow opening 243 and the seal member 244 are covered with a shutter 245. When the toner cartridge 200 is inserted in the image forming apparatus 1, the shutter 245 opens to open the outflow opening 243. The flange 240 is held in a non-rotatable state within the image forming apparatus 1.

The gear 214 provided on the outer peripheral surface 210*a* of the toner bottle 210 is driven by the gear 91 on the image forming apparatus body side. When the toner bottle 210 is rotated by this driving, the toner in the toner bottle 210 is transported toward the opening 211, is taken out from the opening 211, and enters the flange 240. The agitation member 220 rotates together with the toner bottle 210. For this reason, the toner entering the flange 240 flows out of the toner cartridge 200 from the outflow opening 243 while being agitated by the agitating blade 223 of the agitation member 220.

While the toner cartridge 200 is described as the comparative example herein, it corresponds to each of the toner cartridges 100Y, 100M, 100C, and 100K illustrated in FIG. 2. That is, the toner flowing out of this toner cartridge is supplied to the corresponding developing unit 54 via an unillustrated toner supply path and is offered to form a toner image.

Figure 5:
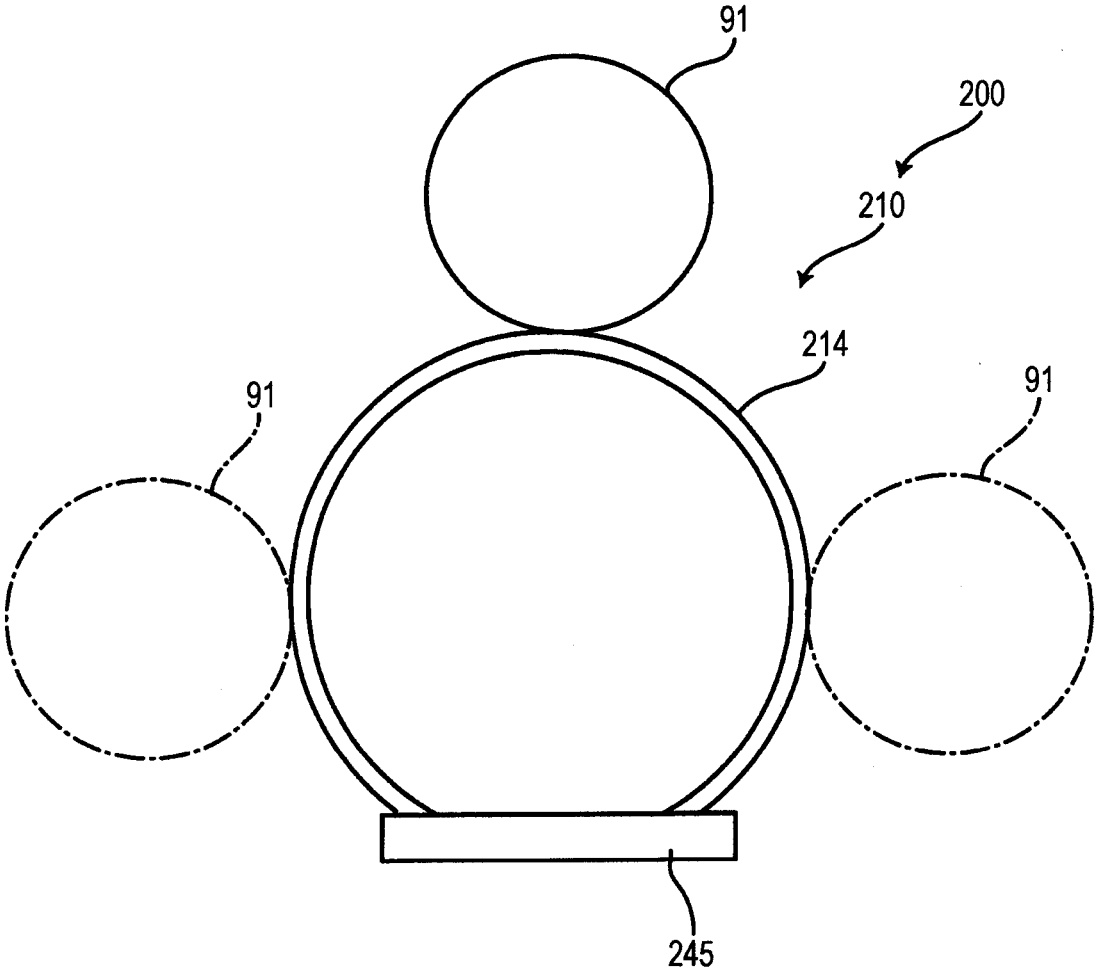
FIG. 5 is a schematic view explaining one problem in the toner cartridge of the comparative example illustrated in FIG. 3.

FIG. 5 is a schematic view explaining one problem in the toner cartridge 200 of the comparative example illustrated in FIG. 3.

As described above, when the toner cartridge 200 is inserted in the image forming apparatus, the gear 214 provided on the outer peripheral surface 210*a* of the toner bottle 210 is engaged with the gear 91 on the apparatus body side. For that purpose, a space where the gear 91 on the apparatus body side is to be disposed is needed at a position adjacent to the toner cartridge 200. The gear 91 requires a considerably large space whichever it is disposed at a position shown by a solid line in FIG. 3 or a position shown by a one-dot chain line in FIG. 3. It is one great problem how to minimize or remove this space.

Returning to FIG. 4, another problem in this comparative example will be described.

The toner bottle 210 included in the toner cartridge 200 is produced by blow molding (hollow molding) because of its shape. Although blow molding is a molding method suitable for molding a cylindrical body like the toner bottle 210, high dimensional accuracy of a component produced by blow molding (herein, toner bottle 210) cannot be expected. Herein, the ring-shaped seal member 230 is disposed within the flange 240, and is pressed and crushed by the toner bottle 210 to close the gap between the flange 240 and the toner bottle 210. Further, since the toner bottle 210 rotates in this state, it slides on the seal member 230 during rotation. Since the toner bottle 210 is formed by blow molding, the dimensional accuracy thereof is low. Thus, according to the toner cartridge 200, the seal member 230 is strongly crushed, or is crushed insufficiently. If the seal member 230 is excessively crushed, the frictional force between the toner bottle 210 and the seal member 230 increases. This may hinder smooth rotation of the toner bottle 210. For this reason, it is necessary to rotate the toner bottle 210 by using a high-torque motor that cancels the great frictional force. This may increase the cost of the motor, outer dimensions, and power consumption. If the crush amount of the seal member 230 is insufficient, toner may leak out from between the flange 240 and the toner bottle 210. Therefore, it is another problem in the comparative example how to maintain a constant crush amount of the seal member 230.

On the basis of the above description of the toner cartridge 200 of the comparative example, a toner cartridge according to the exemplary embodiment of the present invention will be described.

Figure 6:
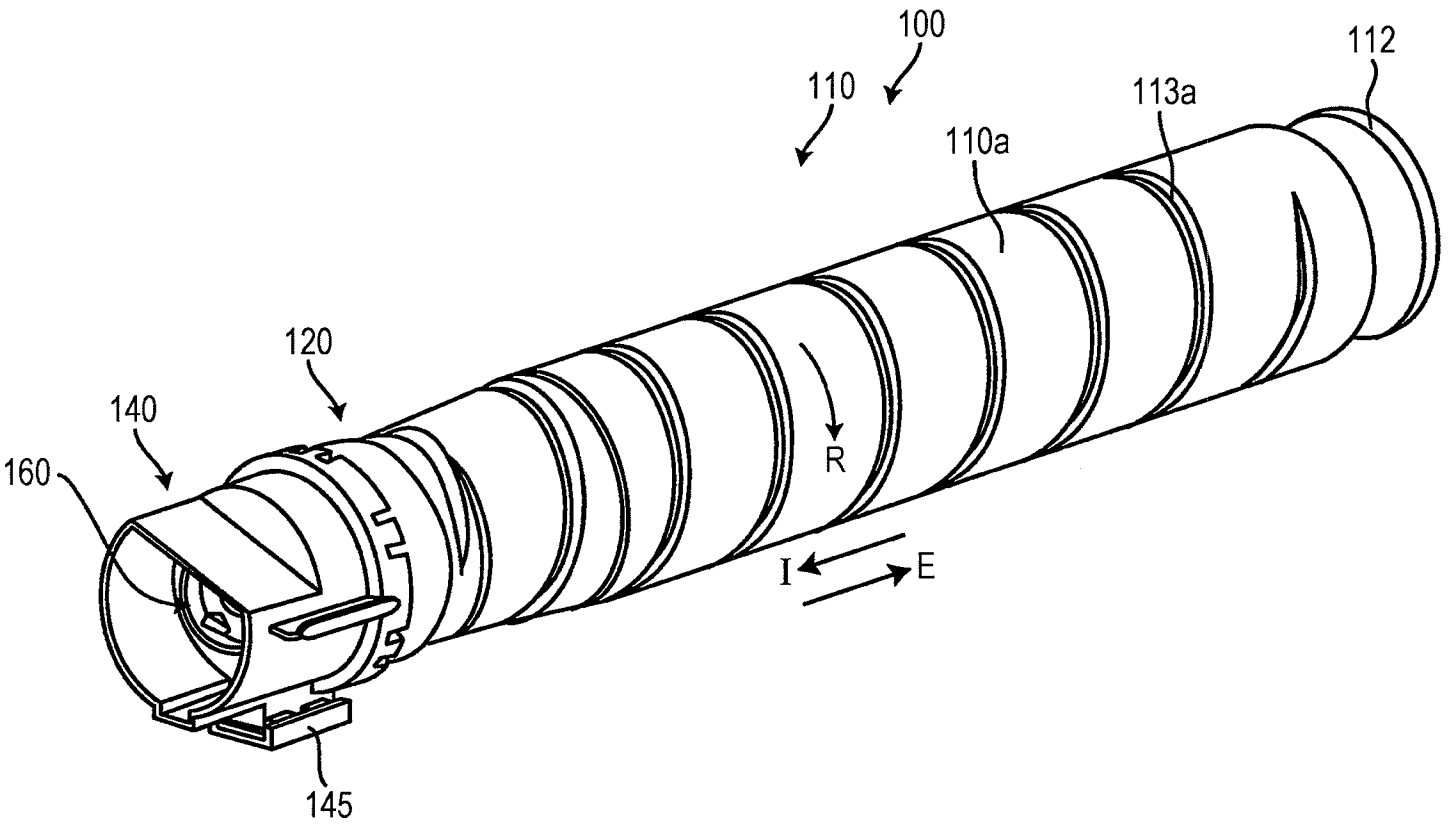
FIG. 6 is a perspective view of a toner cartridge according to the first exemplary embodiment to be adopted in the image forming apparatus illustrated in FIGS. 1 and 2.

FIG. 6 is a perspective view of a toner cartridge 100 according to the first exemplary embodiment to be adopted in the image forming apparatus 1 illustrated in FIGS. 1 and 2.

Figure 7:
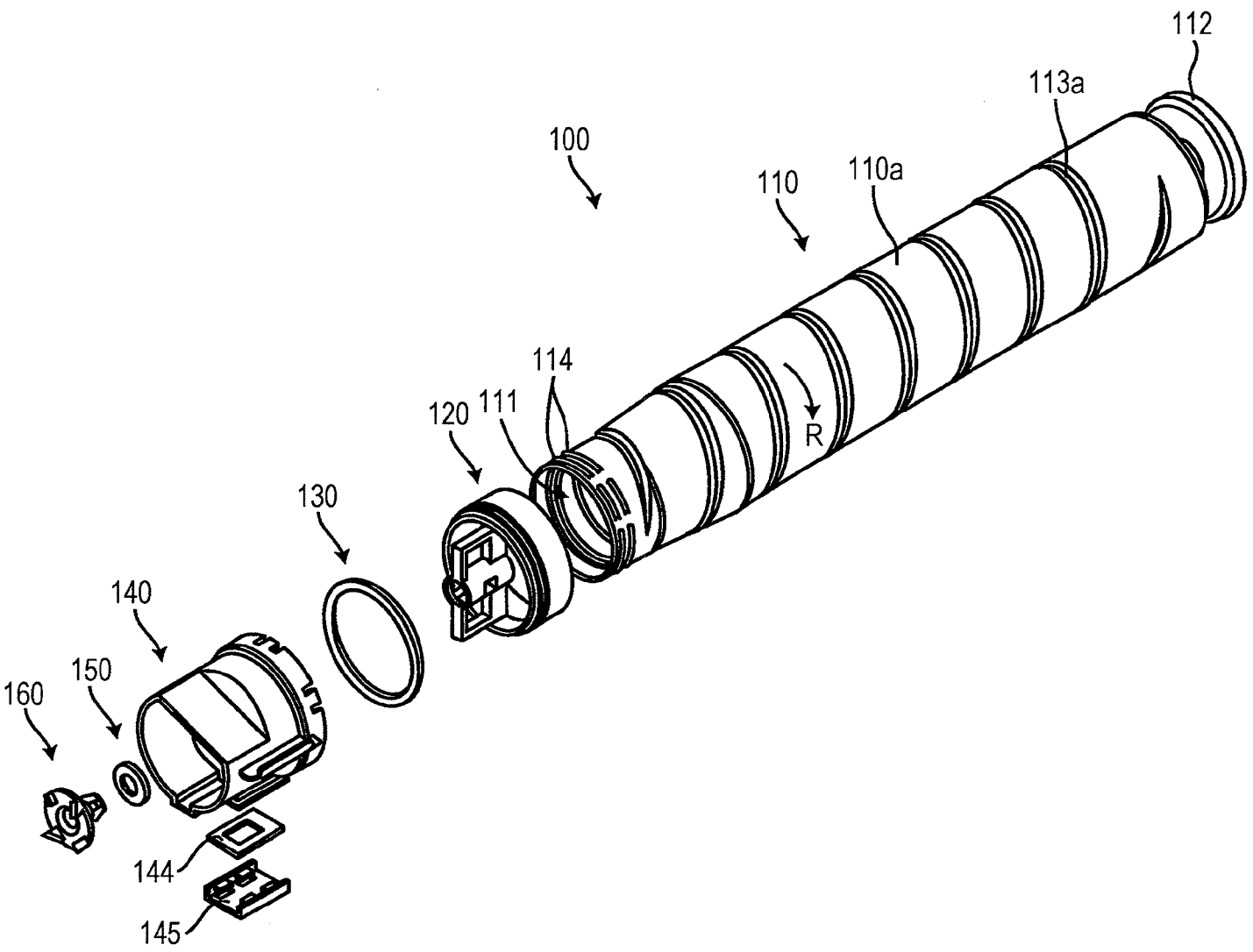
FIG. 7 is an exploded perspective view of the toner cartridge illustrated in FIG. 6.

FIG. 7 is an exploded perspective view of the toner cartridge 100 illustrated in FIG. 6.

Figure 8:
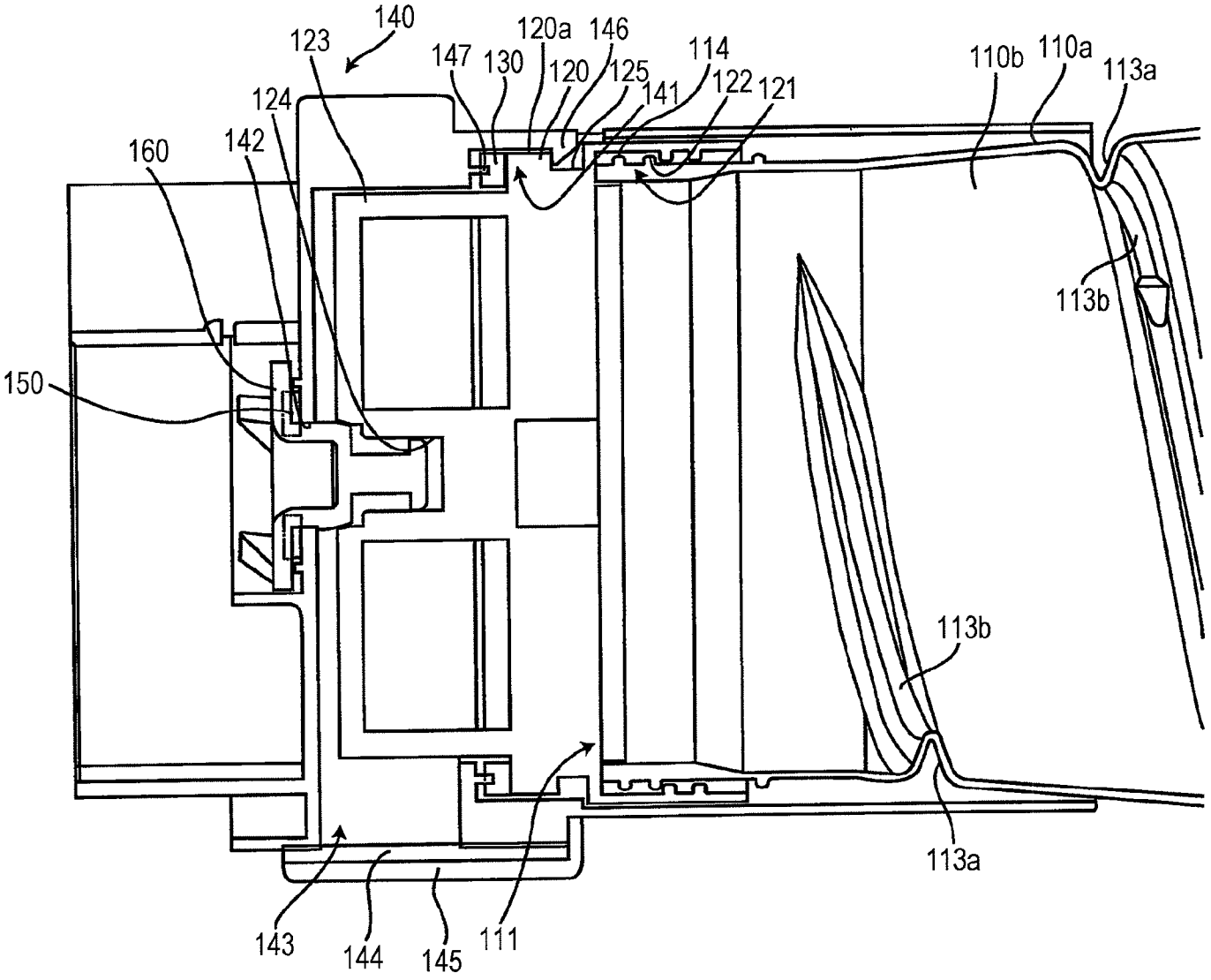
FIG. 8 is a cross-sectional view of a portion near a flange in the toner cartridge illustrated in FIG. 6.

FIG. 8 is a cross-sectional view of a portion near a flange in the toner cartridge 100 illustrated in FIG. 6.

This toner cartridge 100 includes a toner bottle 110, an agitation member 120, a seal member 130, a flange 140, another seal member 150, and a coupling 160. The toner cartridge 100 corresponds to an example of a powder storage device of the present invention. The toner bottle 110 corresponds to an example of a powder container. A combination of the agitation member 120 and the coupling 160 corresponds to an example of a driving-force transmission member. The coupling 160 corresponds to an example of a joint member and an example of a driving-force receiving portion. The flange 140 corresponds to an example of a lid member.

The toner cartridges 100 is assembled in a state illustrated in FIG. 6 after toner is put in the toner bottle 110. The assembled toner cartridge 100 is inserted into the image forming apparatus 1 illustrated in FIGS. 1 and 2. When the toner bottle 110 becomes empty, the toner cartridge 100 is drawn out in a direction of arrow E, and a new toner cartridge 100 is inserted.

The toner bottle 110 is substantially circular, has an opening 111 at one end, and stores toner therein. At the other end of the toner bottle 110, a handle 112 is provided to be gripped when drawing out the toner cartridge 100 from the image forming apparatus 1. A helically extending groove 113*a* is provided in an outer peripheral surface 110*a* of the toner bottle 110. The groove 113*a* projects in an inner peripheral surface 110*b* of the toner bottle 110. That is, a helically extending rib 113*b* is provided on the inner peripheral surface 110*b* of the toner bottle 110. The toner bottle 110 rotates in a direction of arrow R in FIGS. 6 and 7, as will be described later. The toner bottle 110 is filled with toner (not illustrated). When the toner bottle 110 rotates, the toner is transported toward the opening 111 by the helical rib 113*b* on the inner peripheral surface 110*b* of the toner bottle 110. On the outer peripheral surface 110*a* of the toner bottle 110 and near the opening 111, an external thread 114 is provided. On the external thread 114, an internal thread 122 (see FIG. 8) of the agitation member 120 is screwed to fix the agitation member 120 to the toner bottle 110. Therefore, the toner bottle 110 and the agitation member 120 rotate together.

The agitation member 120 has a cylindrical portion 121 opening on the side of the toner bottle 110. The cylindrical portion 121 has an internal thread 122 on its inner peripheral surface. The agitation member 120 also has an agitation blade 123 protruding toward the flange 140. As illustrated in FIG. 8, the flange 140 also has a hollow cylindrical portion 141 opening in a direction such as to face the toner bottle 110. The agitation blade 123 of the agitation member 120 is disposed within the cylindrical portion 141 of the flange 140. The agitation blade 123 agitates the toner moved from the opening 111 of the toner bottle 110 into the flange 140 to prevent agglomeration of the toner. A fitting hole 124 is provided at a distal end of the agitation blade 123. In contrast, a through hole 142 is provided at a position in the flange 140 facing the fitting hole 124. The coupling 160 is fitted in the fitting hole 124 by being inserted in the through hole 142 from the outside of the flange 140 (the side of the flange 140 opposite from the side facing the toner bottle 110, the left side of FIG. 8). When the toner cartridge 100 is inserted in the image forming apparatus 1 (see FIGS. 1 and 2), the coupling 160 is connected to a coupling on the apparatus body side (not illustrated). The coupling 160 is rotated by a motor provided on the apparatus body side (not illustrated) via the coupling on the apparatus body side. Thus, the coupling 160 rotates while serving as a rotation shaft. The coupling 160 is fitted in the through hole 142 of the agitation member 120. Thus, when the coupling 160 rotates, the agitation member 120 rotates together. Further, since the agitation member 120 is fixed to the toner bottle 110, when the agitation member 120 rotates, the toner bottle 110 rotates together with the agitation member 120 while using the coupling 160 as a rotation shaft.

An engaging groove 125 is provided all around an outer peripheral surface 120*a* of the agitation member 120 to extend in the circumferential direction. In contrast, the flange 140 has an engaging claw 146 fitted in the engaging groove 125. The engaging claw 146 fixes the flange 140 to the agitation member 120 in the rotation shaft direction (right-left direction in FIG. 8) and slides on the engaging groove 125 in the rotating direction (direction of arrow R in FIGS. 6 and 7). When the toner cartridge 100 is inserted in the image forming apparatus 1, the flange 140 is fixed in a non-rotatable state to the apparatus body. Therefore, the agitation member 120 rotates while sliding on the engaging claw 146 of the flange 140.

The seal member 130 is ring-shaped and is crushed by a circular helical rib 147 of the flange 140 while being kept between the agitation member 120 and the flange 140. The seal member 130 prevents the toner from leaking out from between the agitation member 120 and the flange 140. Another seal member 150 is disposed at a position such as to surround the through hole 142 of the flange 140, and prevents the toner from leaking out from the through hole 142 of the flange 140.

The flange 140 functions as a lid for the toner bottle 110, and has an outflow opening 143 from which the toner is to flow out. The periphery of the outflow opening 143 is covered with a further seal member 144. Further, the outflow opening 143 and the seal member 144 are covered with a shutter 145. The shutter 145 is opened when the toner cartridge 100 is inserted in the image forming apparatus 1, and is closed when the toner cartridge 100 is drawn out. As described above, when the toner cartridge 100 is inserted in the image forming apparatus 1, the shutter 145 is opened and the flange 240 is held in a non-rotatable state. Further, the coupling (not illustrated) on the apparatus body side is connected to the coupling 160 of the toner cartridge 100. The coupling 160 is rotated by the motor on the apparatus body side via the coupling on the apparatus body side. By this rotation, the agitation member 120 and the toner bottle 110 in the toner cartridge 100 are rotated. By the rotation of the toner bottle 110, the toner in the toner bottle 110 is transported toward the opening 111, is taken out from the opening 111, and enters the flange 140. The toner entering the flange 140 flows out of the toner cartridge 100 through the outflow opening 143 while being agitated by the agitation blade 123 of the agitation member 120.

The toner cartridge 100 of the first exemplary embodiment described herein is representative of the toner cartridges 100Y, 100M, 100C, and 100K illustrated in FIG. 2. That is, the toner flowing out of the toner cartridge 100 is supplied to the corresponding developing unit 54 to be used for formation of a toner image.

In the toner cartridge 100 of the first exemplary embodiment, the toner bottle 110 is also produced by blow molding. However, in the toner cartridge 100, the seal member 130 is located between the agitation member 120 and the flange 140, and the crush amount of the seal member 130 is unrelated to the accuracy of the toner bottle 110. Both the agitation member 120 and the flange 140 are produced by injection molding.

This also applies to the ring-shaped seal member 150. The seal member 150 is provided between the coupling 160 and the flange 140. The coupling 160 and the flange 140 are produced by injection molding.

The toner cartridge 100 of the first exemplary embodiment is inserted in the apparatus body in a direction of arrow I in FIGS. 6 and 7, and is drawn out from the apparatus body in a direction of arrow E by pulling the handle 112.

For this reason, the driving unit for rotating the toner cartridge 100 is provided on the depth side (distal side in the direction of arrow I) of the apparatus body. The toner cartridge 100 is rotated via the coupling 160 provided on the distal side in the direction of arrow I.

Next, a toner cartridge 300 according to a second exemplary embodiment will be described.

Figure 9:
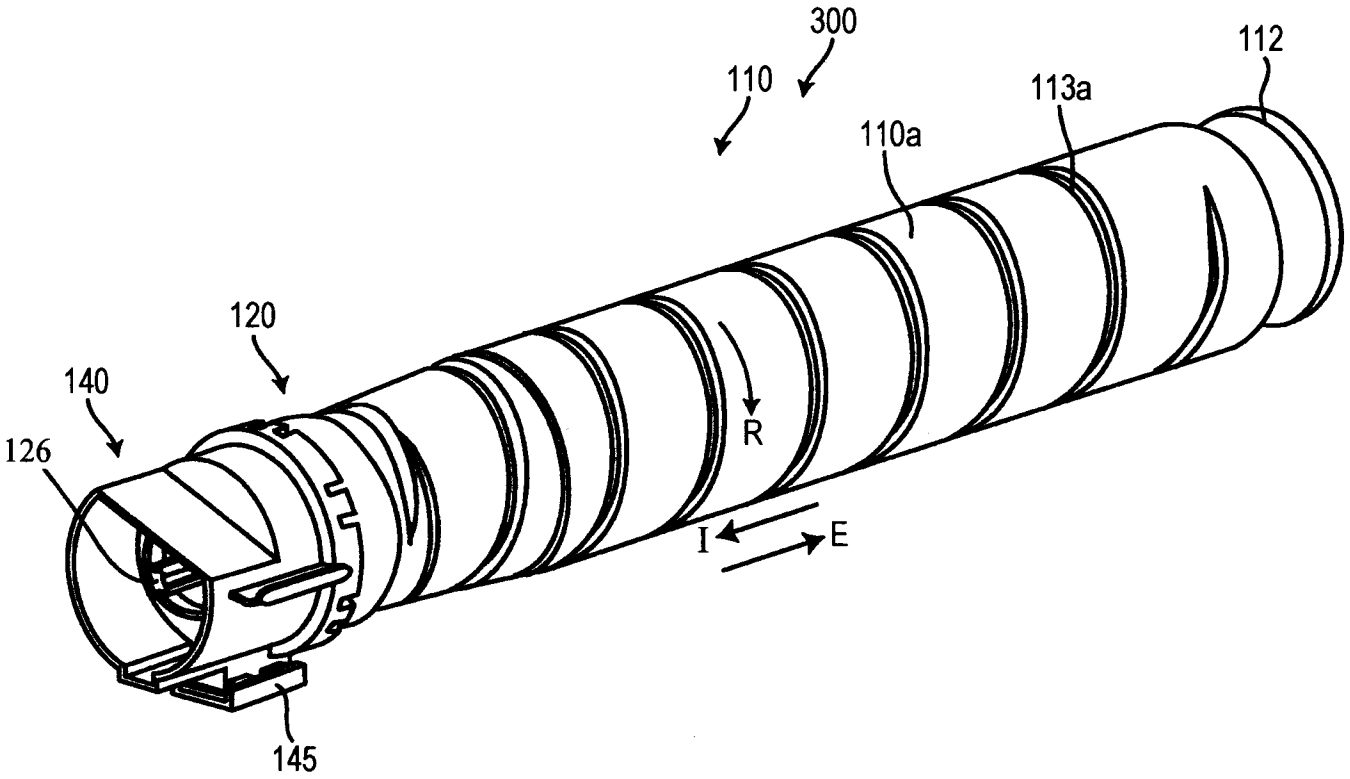
FIG. 9 is a perspective view of a toner cartridge according to a second exemplary embodiment.

FIG. 9 is a perspective view of the toner cartridge 300 according to the second exemplary embodiment.

Figure 10:
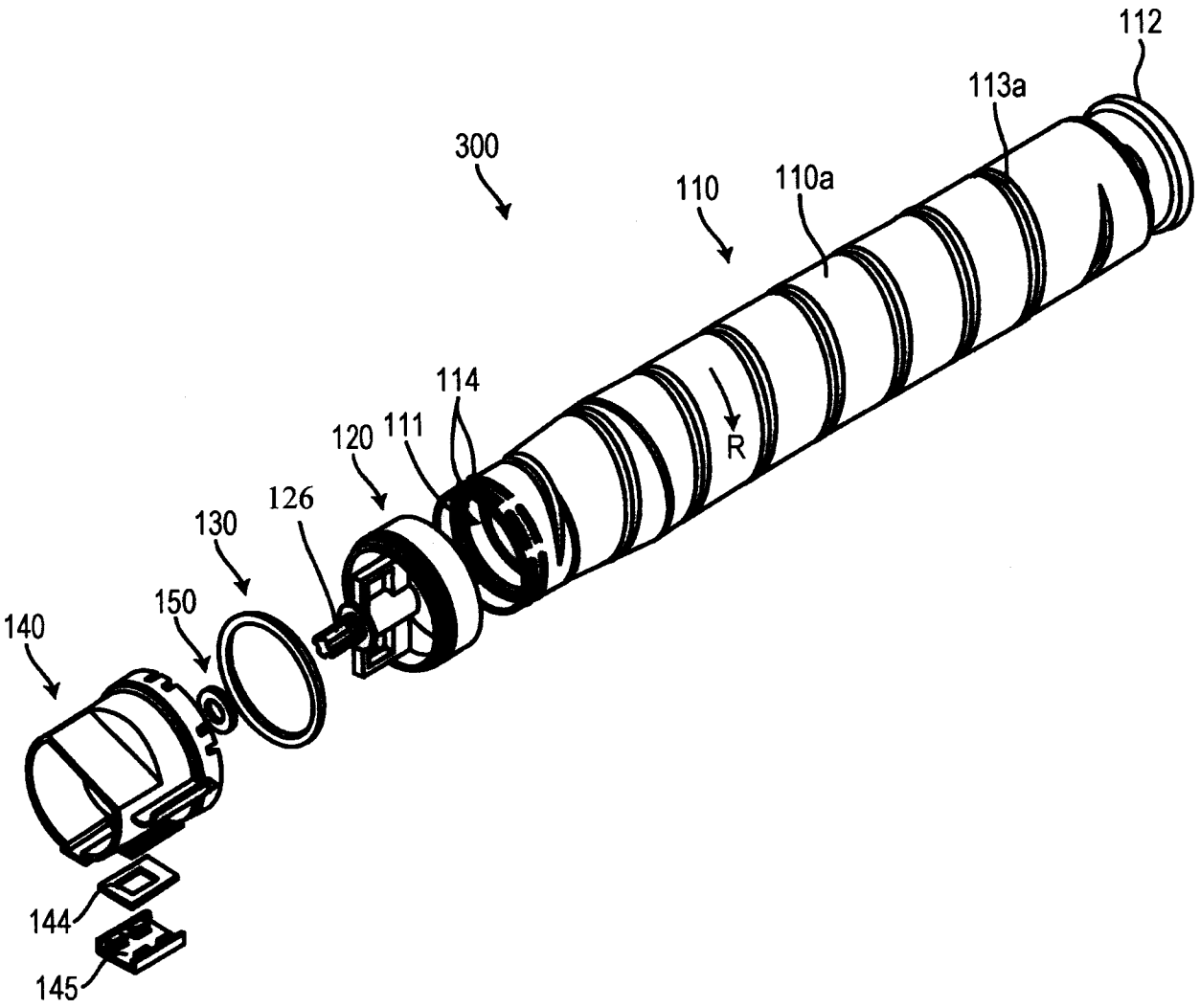
FIG. 10 is an exploded perspective view of the toner cartridge illustrated in FIG. 9.

FIG. 10 is an exploded perspective view of the toner cartridge 300 illustrated in FIG. 9.

Figure 11:
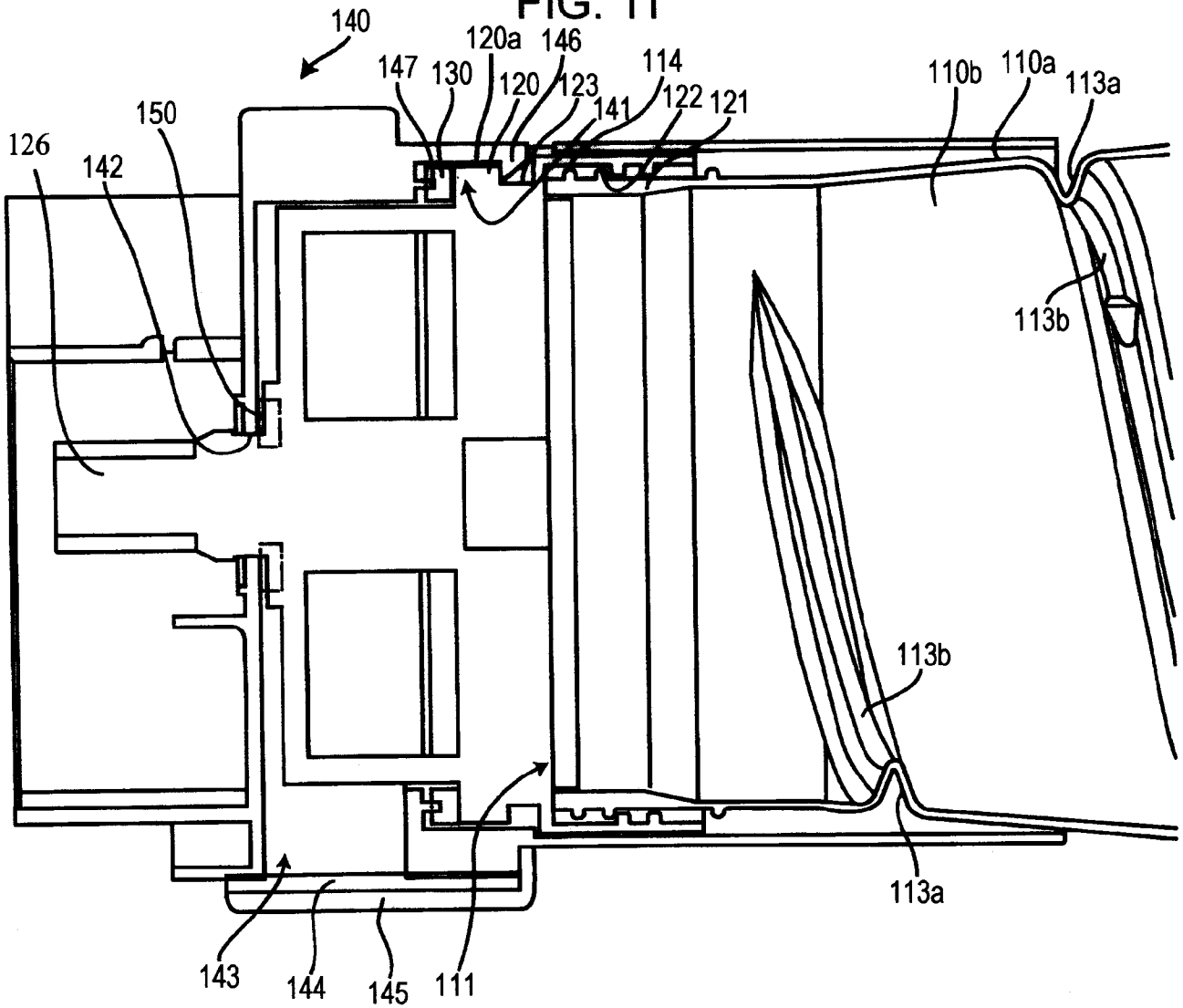
FIG. 11 is a cross-sectional view of a portion near a flange in the toner cartridge illustrated in FIG. 9.

FIG. 11 is a cross-sectional view of a portion near a flange in the toner cartridge 300 illustrated in FIG. 9.

FIGS. 9 to 11 correspond to FIGS. 6 to 8 of the above-described first exemplary embodiment, respectively. Herein, elements identical or corresponding to the elements of the toner cartridge 100 of the first exemplary embodiment are denoted by the same reference numerals adopted in FIGS. 6 to 8, and only differences from the first exemplary embodiment will be described.

In the above-described toner cartridge 100 of the first exemplary embodiment, as illustrated in FIG. 8, the agitation member 120 has the fitting hole 124, and the coupling 160 is fitted in the fitting hole 124 by being inserted in the through hole 142 of the flange 140 from the outside of the flange 140 (left side of FIG. 8).

In contrast, in the toner cartridge 300 of the second exemplary embodiment described herein, an agitation member 120 has a driving-force receiving portion 126 protruding on the rotation axis in a rodlike shape, instead of the fitting hole 124 illustrated in FIG. 8. The driving-force receiving portion 126 provided in the agitation member 120 penetrates a through hole 142 provided in a flange 140 outward (toward a side opposite from a side facing a toner bottle 110) from the inside of the flange 140 (a side of the flange 140 facing the toner bottle 110). With this, a ring-shaped seal member 150 is disposed at a position around the through hole 142 on an inner side of the flange 140 and between the flange 140 and the agitation member 120.

In an image forming apparatus in which the toner cartridge 300 is to be inserted, a coupling to be fitted on the driving-force receiving portion 126 of the agitation member 120 is provided. When the toner cartridge 300 is inserted in the image forming apparatus, the coupling on the apparatus body side and the driving-force receiving portion 126 of the agitation member 120 in the toner cartridge 300 are fitted together. Similarly to the above-described first exemplary embodiment, when the toner cartridge 300 is inserted in the image forming apparatus, a shutter 145 is opened, and the flange 140 is fixed in a non-rotatable state. The image forming apparatus in which the toner cartridge 300 is to be inserted includes the coupling to be fitted on the driving-force receiving portion 126 and a motor for rotating the coupling. When the motor rotates, rotating force is transmitted to the driving-force receiving portion 126 via the coupling, and the agitation member 120 and the toner bottle 110 are rotated on the driving-force receiving portion 126 serving as a rotation shaft. In the toner cartridge 300 of the second exemplary embodiment, the agitation member 120 corresponds to an example of a driving-force transmission member.

The toner cartridge 300 of the second exemplary embodiment is the same as the toner cartridge 100 of the above-described first exemplary embodiment except in the above-described points, and redundant descriptions thereof are skipped.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder storage device comprising:

a powder container that has an opening at one end, stores powder therein, and has, on an inner peripheral surface, a rib configured to transport the powder toward the opening with rotation of the powder container;

a lid member that is configured to cover the opening, has an outflow opening through which the powder flows, and is held in a non-rotatable state; and a driving-force transmission member interposed between the powder container and the lid member and having a driving-force receiving portion penetrating the lid member in a rotation axis direction, the driving-force transmission member transmitting a rotating force to the powder container, wherein the lid member engages over a portion of an outer surface of the driving-force transmission member, which engages over a portion of an outer surface of the powder container.

2. The powder storage device according to claim 1, wherein the lid member has a hollow cylindrical portion that is opened in a direction such as to face the powder container and forms a hollow space, and wherein the driving-force transmission member has an agitating portion disposed within the hollow space to agitate the powder in the cylindrical portion by rotation.

3. The powder storage device according to claim 1, wherein the driving-force receiving portion is formed by a joint member inserted in the lid member from a side of the lid member opposite from a side facing the powder container.

4. The powder storage device according to claim 2, wherein the driving-force receiving portion is formed by a joint member inserted in the lid member from a side of the lid member opposite from a side facing the powder container.

5. The powder storage device according to claim 1, wherein the driving-force receiving portion penetrates the lid member toward a side opposite from the facing side of the lid member facing the powder container.

6. The powder storage device according to claim 2, wherein the driving-force receiving portion penetrates the lid member toward a side opposite from the facing side of the lid member facing the powder container.

7. The powder storage device according to claim 1, wherein the powder container comprises an outer peripheral surface, and on the outer peripheral surface, an engagement portion is provided to engage with the driving-force transmission member.

8. The powder storage device according to claim 1, wherein the driving-force receiving portion protrudes on the rotation axis in a rod-like shape and penetrates a through hole in the lid member toward a side that is opposite from a side facing a powder container.

9. A powder storage device comprising:

a powder container that has an opening at one end, stores powder therein, and has, on an inner peripheral surface, a rib configured to transport the powder toward the opening with rotation of the powder container;

a lid member that is configured to cover the opening, has an outflow opening through which the powder flows, and is held in a non-rotatable state; and a driving-force transmission member that has a driving-force receiving portion and transmits a rotating force to the powder container, wherein the driving-force receiving portion is configured to constitute a rotation shaft of the powder container, and wherein the lid member engages over a portion of an outer surface of the driving-force transmission member, which engages over a portion of an outer surface of the powder container.

10. The powder storage device according to claim 9, wherein the powder container comprises an outer peripheral surface, and on the outer peripheral surface, an engagement portion is provided to engage with the driving-force transmission member.

11. A powder storage device comprising:

a powder container that has an opening at one end, stores powder therein, and has, on an inner peripheral surface, a rib configured to transport the powder toward the opening with rotation of the powder container;

a lid member that is configured to cover the opening, has an outflow opening through which the powder flows, and is held in a non-rotatable state; and a driving-force transmission member that has a driving-force receiving portion and transmits a rotating force to the powder container, wherein a rotation axis of the driving-force transmission member is substantially the same as a rotation axis of the powder container, and wherein the lid member engages over a portion of an outer surface of the driving-force transmission member, which engages over a portion of an outer surface of the powder container.

12. The powder storage device according to claim 11, wherein the powder container comprises an outer peripheral surface, and on the outer peripheral surface, an engagement portion is provided to engage with the driving-force transmission member.

13. A powder storage device comprising:

a powder container that has an opening at one end, stores powder therein, and has, on an inner peripheral surface, a rib configured to transport the powder toward the opening with rotation of the powder container;

a lid member that is configured to cover the opening, has an outflow opening through which the powder flows, and is held in a non-rotatable state; and a driving-force transmission member interposed between the powder container and the lid member and having a driving-force receiving portion penetrating the lid member in a rotation axis direction, the driving-force transmission member transmitting a rotating force to the powder container, wherein the lid member has a hollow cylindrical portion that is opened in a direction such as to face the powder container and forms a hollow space, and wherein the driving-force transmission member has an agitating portion disposed within the hollow space to agitate the powder in the cylindrical portion by rotation, and wherein the agitating portion rotates together with the powder container.

14. A powder storage device comprising:

a powder container that has an opening at one end, stores powder therein, and has, on an inner peripheral surface, a rib configured to transport the powder toward the opening with rotation of the powder container;

a lid member that is configured to cover the opening, has an outflow opening through which the powder flows, and is held in a non-rotatable state; and a driving-force transmission member interposed between the powder container and the lid member and having a driving-force receiving portion penetrating the lid member in a rotation axis direction, the driving-force transmission member transmitting a rotating force to the powder container, wherein the lid member has a hollow cylindrical portion that is opened in a direction such as to face the powder container and forms a hollow space, and wherein the driving-force transmission member has an agitating portion disposed within the hollow space to agitate the powder in the cylindrical portion by rotation, wherein the agitating portion is disposed above the outflow opening, and wherein the agitating portion comprises a blade that is spaced apart from a rotating axis of the driving-force transmission member.

15. The powder storage device according to claim 14, wherein the blade is disposed above the outflow opening.

16. The powder storage device according to claim 14, wherein the blade comprises a fitting hole at a distal end of the blade.

17. The powder storage device according to claim 16, wherein the lid member comprises a through hole that faces the fitting hole.

18. The powder storage device according to claim 17, wherein the driving-force receiving portion penetrates the lid member through the through hole and is fitted into the fitting hole.

* * * * *